US008529305B2

(12) United States Patent
Lin

(10) Patent No.: US 8,529,305 B2
(45) Date of Patent: Sep. 10, 2013

(54) ELECTRIC OUTBOARD DRIVE

(75) Inventor: Yeun-Junn Lin, Taichung (TW)

(73) Assignee: Solas Science & Engineering Co., Ltd., Taichung (TW)

( * ) Notice: Subject to any disclaimer, the term of this patent is extended or adjusted under 35 U.S.C. 154(b) by 117 days.

(21) Appl. No.: 13/159,708

(22) Filed: Jun. 14, 2011

(65) Prior Publication Data

US 2012/0282825 A1 Nov. 8, 2012

(30) Foreign Application Priority Data

May 5, 2011 (TW) ..... 100208012 U

(51) Int. Cl.
*B63H 21/17* (2006.01)

(52) U.S. Cl.
USPC ..... 440/6

(58) Field of Classification Search
USPC ..... 440/6
See application file for complete search history.

(56) References Cited

U.S. PATENT DOCUMENTS 6,458,004 B2 * 10/2002 Van Breems ..... 440/6
7,597,597 B2 * 10/2009 Oishi et al. ..... 440/1
7,614,925 B2 11/2009 Boebel et al.

* cited by examiner

*Primary Examiner* — Stephen Avila
(74) *Attorney, Agent, or Firm* — Browdy and Neimark, PLLC

(57) ABSTRACT

An electric outboard drive adapted to be mounted on a transom of a boat through a mounting bracket includes a driving device and a propelling device. Through engagement of a first transmission shaft with a second transmission shaft, the power of an electric motor of the driving device is transmitted to a propeller of the propelling device. As a result, when the electric motor drives the first transmission shaft to rotate, the propeller is rotated by the transmission of the second transmission shaft to propel the boat.

6 Claims, 7 Drawing Sheets

ELECTRIC OUTBOARD DRIVE

BACKGROUND OF THE INVENTION

1. Field of the Invention

The present invention relates generally to an outboard drive for propelling a boat and more particularly, to an electric outboard drive that is lightweight and low-pollution.

2. Description of the Related Art

An outboard drive for attaching to the transom of a boat is a propulsion system adapted to be especially used for small watercrafts, such as pneumatic boats and speedboats. To date, most of the outboard drives utilize gasoline engines as their power source. However, the gasoline engine will produce loud noise when it is running and the exhausted waste gas after combustion of gasoline will adversely affect the health of passages and the environment. In addition, the gasoline engine may discharge oil soil, which will contaminate water. Therefore, the outboard drives adopting gasoline engine as power source may be an unpopular option because they can hardly meet the environment protection requirements nowadays. Further, in order to effect the steering control of the boat, the outboard drive needs to be equipped with a steering mechanism, which is usually complicated in its structure, thereby raising the manufacturing coats. Furthermore, conventional gasoline engines are heavy in weight; therefore, they can not be conveniently detached from the boat for transportation and storage, thereby increasing the risk of being stolen.

U.S. Pat. No. 7,614,925 disclosed a transportable outboard motor which utilizes an electric motor as its power source. Using an electric motor substituting for the gasoline engine is an environmentally friendly option that can improve the above-mentioned disadvantages of the gasoline-powered outboard drive. However, in the aforesaid US patent, the electric motor is configured to be installed inside the pylon that has a limit space, which in turn limits the specifications of the electric motors that can be used in this design, i.e. a big electric motor having a relatively big power output may not be used in the aforesaid design. This setup limits the power output of the outboard drive, resulting in that the power output provided by this kind of electric outboard motor may be insufficient for a lager boat.

SUMMARY OF THE INVENTION

The present invention has been accomplished in view of the above-noted circumstances. It is therefore one objective of the present invention to provide an electric outboard drive which is compact in configuration, light in weight, and low in pollution.

Another objective of the present invention is to provide an electric outboard drive, in which various sizes of electric motors without a special limit in specification can be used so as to provide sufficient power to propel the boat.

To achieve the above-mentioned objectives, the electric outboard drive provided by the present invention comprises a driving device, a mounting bracket, a propelling device and a connecting tube. The driving device includes a motor housing, an electric motor mounted inside the housing and provided with an output shaft, and a first transmission shaft extending downwardly and having a top end connected with the output shaft of the electric motor. The mounting bracket is adapted for being detachably mounted to the transom of the boat. The housing of the driving device is rotatably connected with the mounting bracket. The propelling device includes a fluid guiding member, a second transmission shaft and a propeller. A bottom end of the first transmission shaft extends into the fluid guiding member. The second transmission shaft is transversely and rotatably disposed in the fluid guiding member and provided with a front end engaged with the bottom end of the first transmission shaft, and a rear end extending out of the fluid guiding member. The propeller is connected with the rear end of the second transmission shaft. The connecting tube is connected between the motor housing of the driving device and the fluid guiding member of the propelling device and houses the first transmission shaft. As a result, when the electric motor drives the first transmission shaft to rotate, the second transmission shaft, which is synchronously rotated with the first transmission shaft, will drive the propeller to rotate so as to propel the boat.

It can be understood from the above-mentioned description that the electric outboard drive of the present invention utilizes the electric motor substituting for the conventional gasoline engine to reduce its overall weight and lower the pollution of the exhausted waste gas produced by the gasoline engine, such that the electric outboard drive of the present invention can meet the environmental protection requirement and be easily detached from the boat for storage and/or transportation. In addition, the motor used in the electric outboard drive of the present invention is not limited to special specifications. In other words, various electric motors having different sizes and powers can be chosen for providing sufficient propulsion power according to the actual need.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
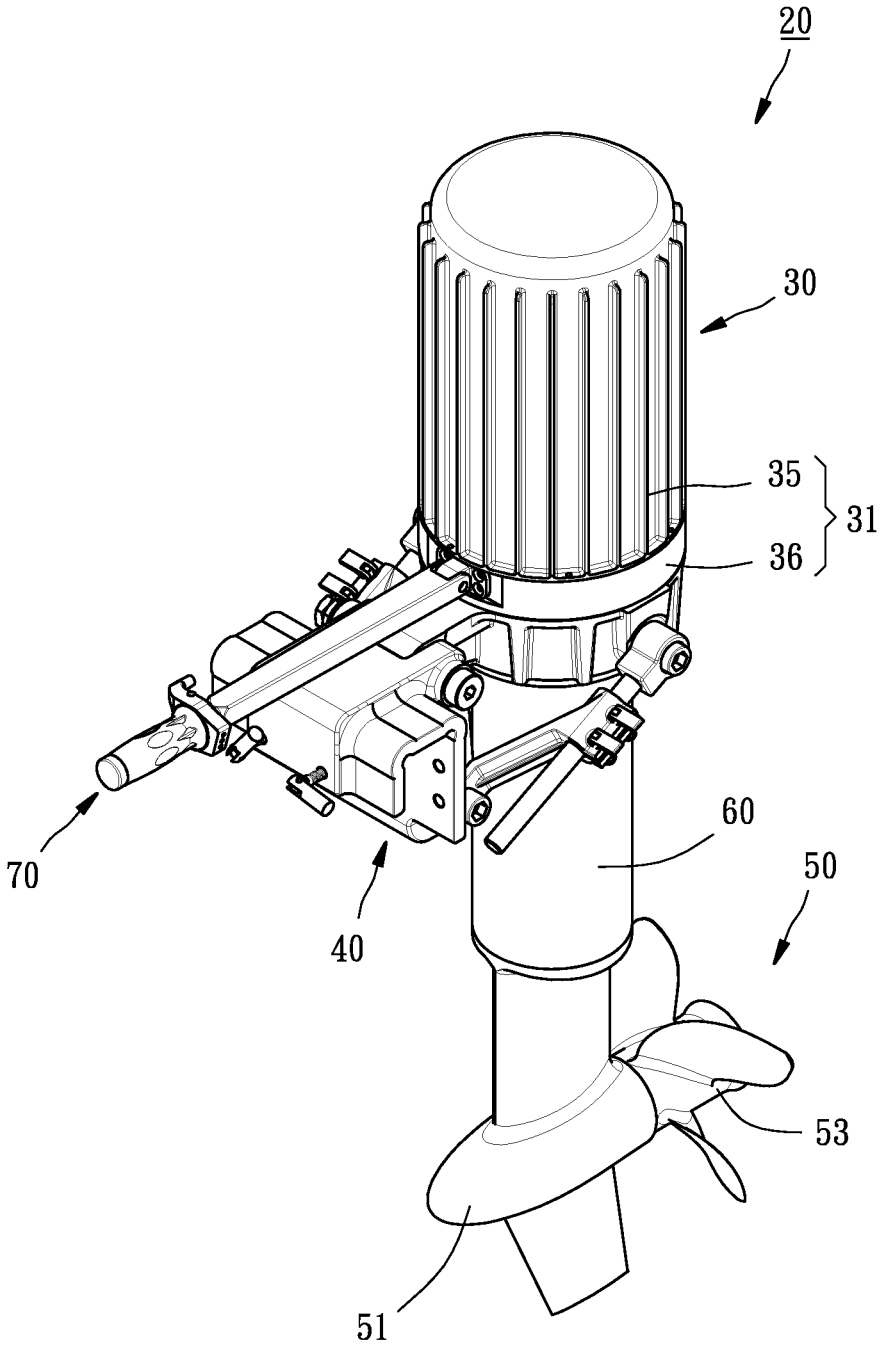
FIG. 1 is a perspective view of an electric outboard drive according to a preferred embodiment of the present invention.
Figure 2:
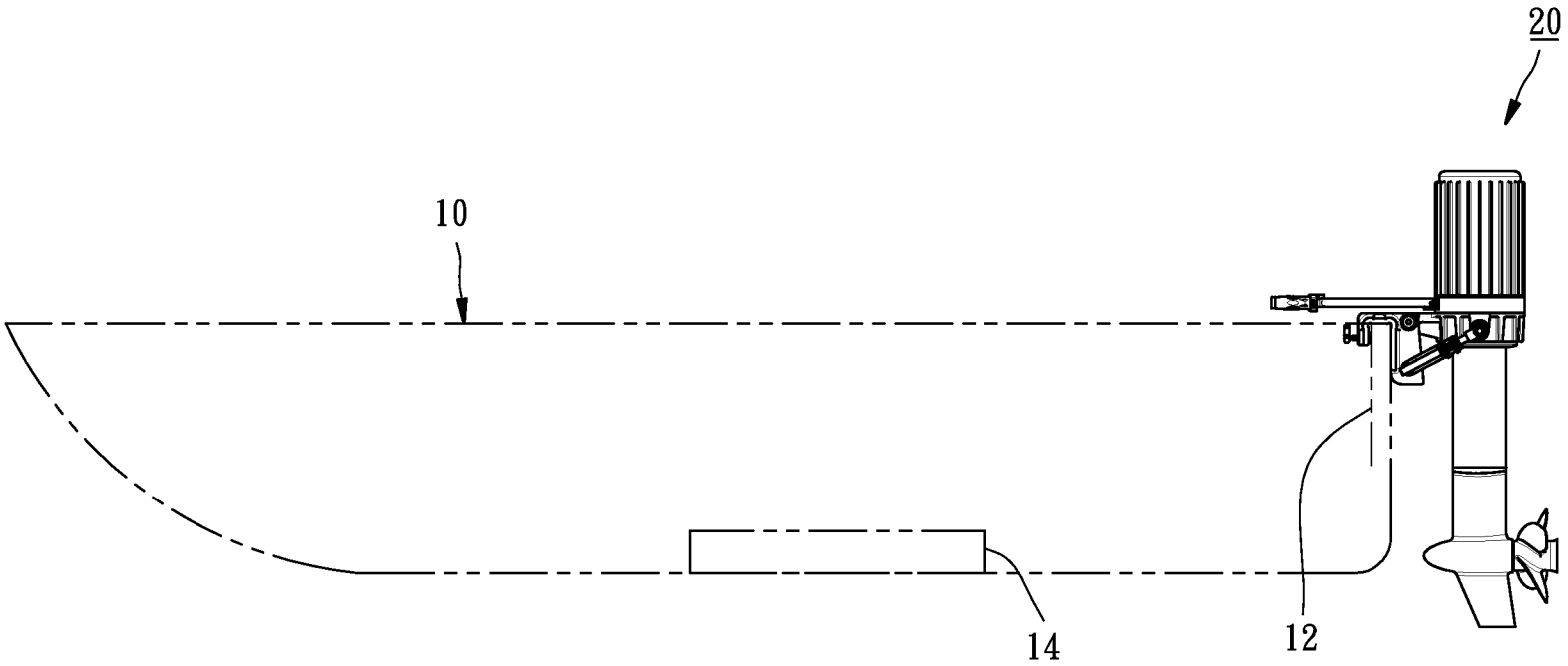
FIG. 2 is a schematic drawing showing that the electric outboard drive of the present invention is mounted to the transom of a boat.
Figure 3:
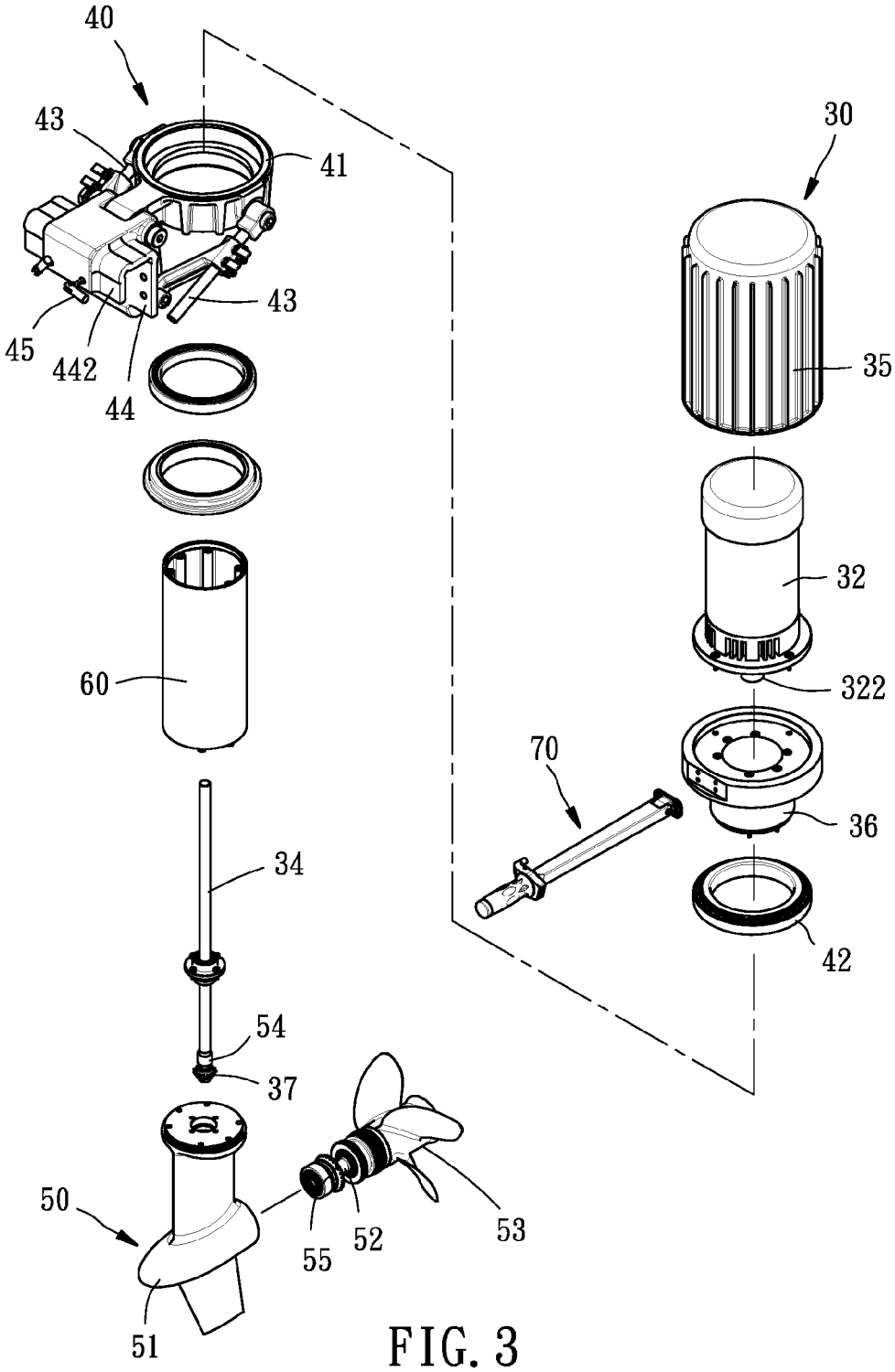
FIG. 3 is a partially exploded view of the electric outboard drive of the preferred embodiment of the present invention.
Figure 4:
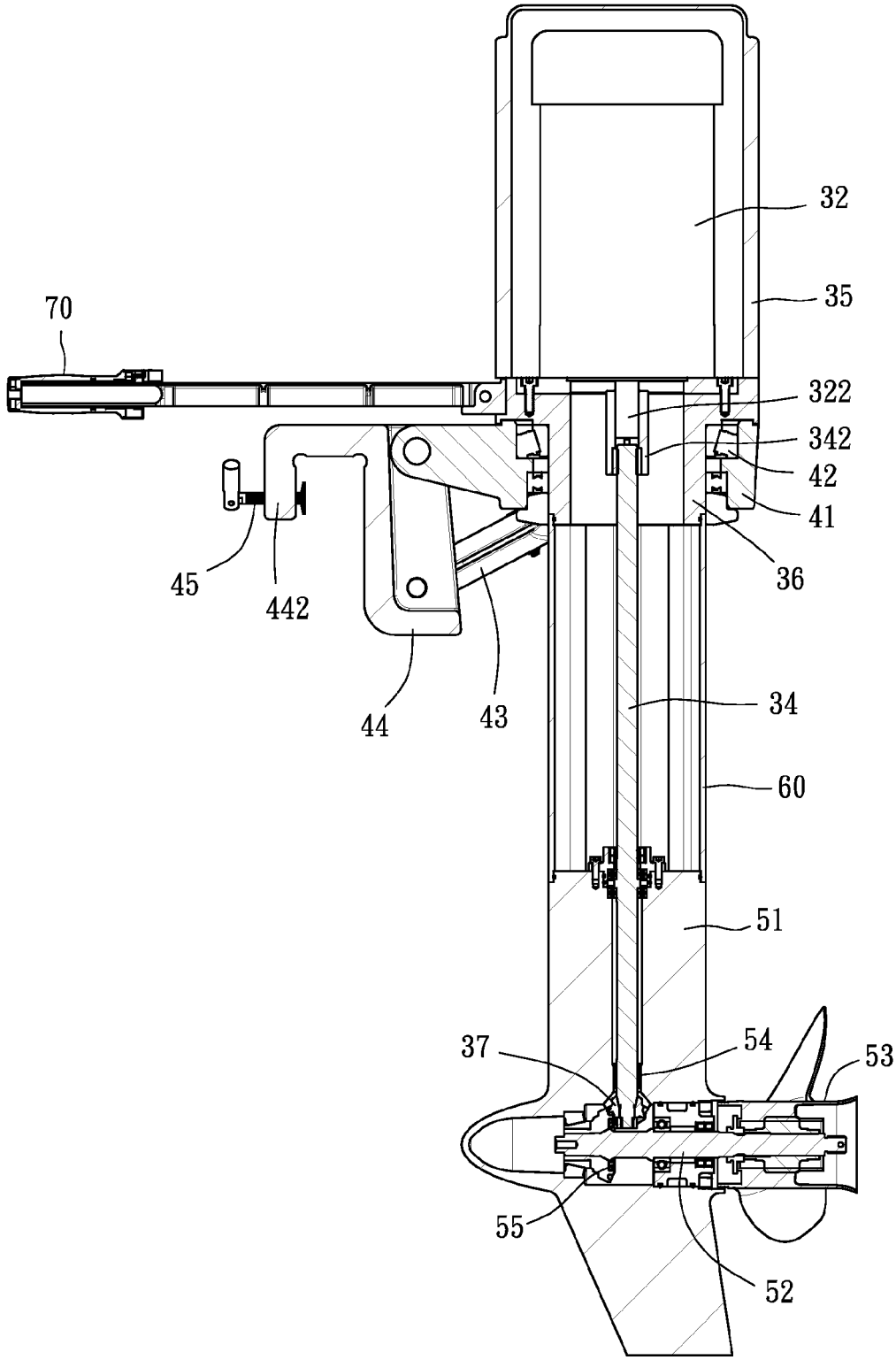
FIG. 4 is a cross-sectional view of the electric outboard drive of the preferred embodiment of the present invention.

As shown in FIGS. 1-2, an electric outboard drive 20 provided according to a preferred embodiment of the present invention is adapted to be mounted on a transom 12 of a boat 10. The electric outboard drive 20 comprises mainly a driving device 30, a mounting bracket 40, a propelling device 50 and a connecting tube 60. Referring to FIGS. 1-4, the driving device 30 includes a motor housing 31, an electric motor 32 and a first transmission shaft 34. The motor housing 31 has a hollow shell 35 and a base 36 on which the shell 35 is fasted. The electric motor 32 is fixedly mounted on the base 36, covered by the shell 35, and electrically connected with a battery unit 14, which is disposed under the deck of the boat 10 as shown in FIG. 2. Through a coupling 342, a top end of the first transmission shaft 34 is connected with an output shaft 322 of the motor 32 in such a way that the first transmission shaft 34 extends vertically and downwardly relative to the motor housing 31 and is driven to rotate by the output shaft 322. In addition, the bottom end of the first transmission shaft 34 is provided with a first gear 37.

The mounting bracket 40 is composed of a mounting collar 41, a needle roller bearing 42, two links 43, a hanger 44 and a tightening bolt 45. The mounting collar 41 is sleeved onto the base 36 of the motor housing 31 in such a way that the needle roller bearing 42 is disposed between the mounting collar 41 and the base 36 of the motor housing 31. In this way, the driving device 30 is rotatable relative to the mounting bracket 40. Each of the two links 43 has a first end pivotally connected to one of two opposite sides of the mounting collar 41. The hanger 44 has a top edge pivotally connected with the mounting collar 41 and a bottom edge pivotally connected with a second end of each of the links 43. A front portion of the hanger 44 is bent to form a hanging rack 422 for being hung on the transom 12 of the boat 10. The tightening bolt 45 is screwingly inserted into the hanging rack 442 and has a free end for stopping at the transom 12 of the boat 10 to therefore fix the hanger 40.

The propelling device 50 is composed of a fluid guiding member 51, a second transmission shaft 52 and a propeller 53. The bottom end of the first transmission shaft 34 is inserted into the fluid guiding member 51 in such a way that a needle roller bearing 54 is disposed between the first transmission shaft 34 and the fluid guiding member 51. The second transmission shaft 52 is transversely and rotatably disposed in the fluid guiding member 51 and provided with a front end having a second gear 55 engaged with the first gear 37, and a rear end extending out of the fluid guiding member 51 and being connected with the propeller 53 in such a way that the first transmission shaft 34 is substantially perpendicular to the second transmission shaft 52. By means of the engagement of the first gear 37 with the second gear 55, the second transmission shaft 52 can be driven by the actuation of the first transmission shaft 34 to rotate, which in turn can drive the propeller 53 to rotate.

The connecting tube 60 is an aluminum-extruding tube and connected between the base 36 of the motor housing 31 of the driving device 30 and the fluid guiding member 51 of the propelling device 50 in such a way that the connecting tube 60 houses the first transmission shaft 34. The connecting tube 60 can enhance the overall structural strength of the electric outboard drive.

Figure 5:
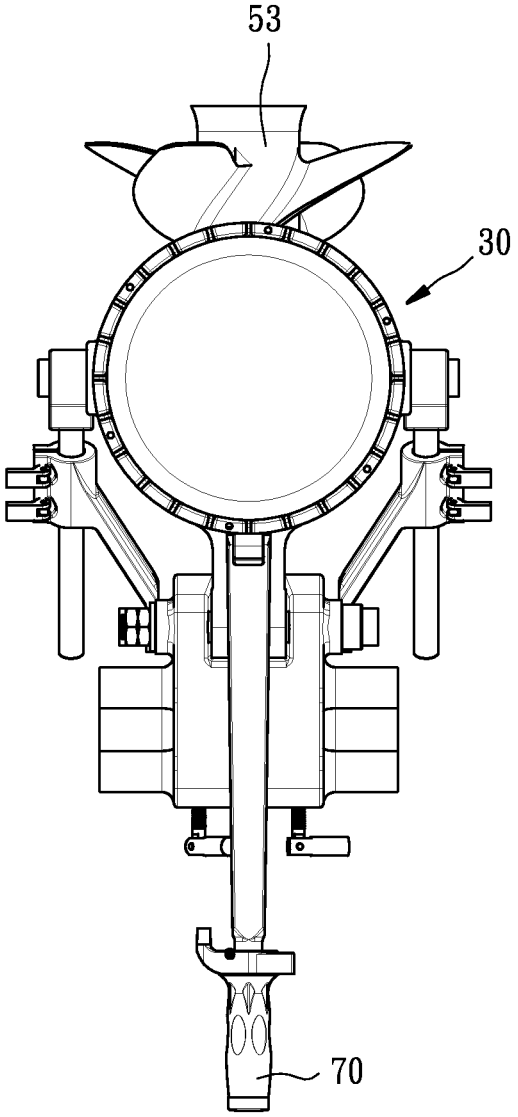
FIG. 5 is a top view of the electric outboard drive of the preferred embodiment of the present invention.
Figure 6:
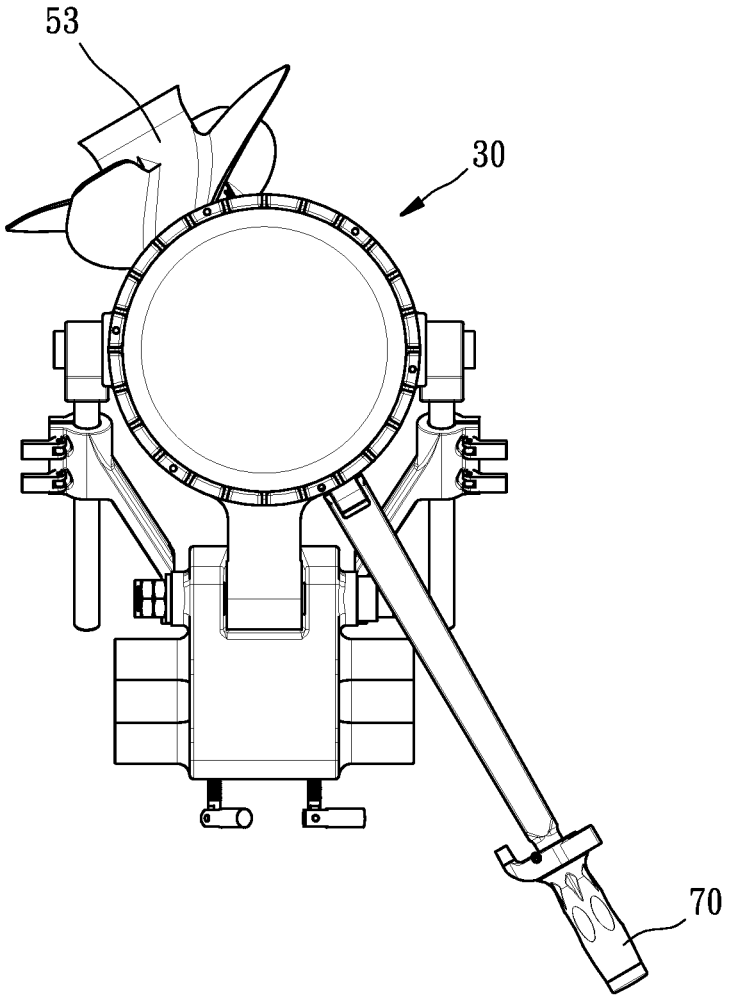
FIG. 6 is similar to FIG. 5, but showing that the propeller is revolved counterclockwise.
Figure 7:
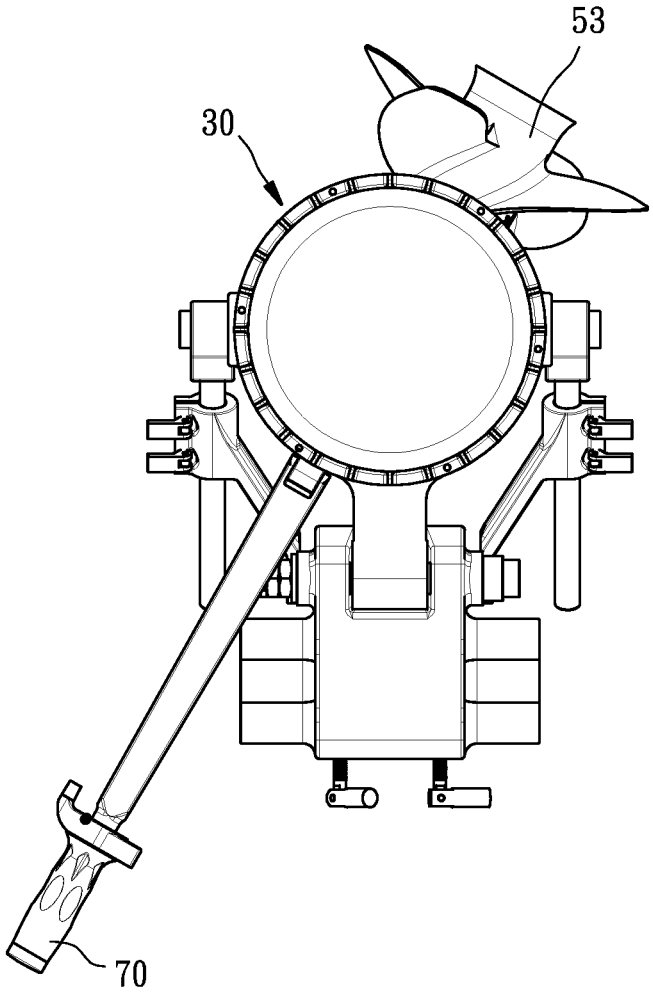
FIG. 7 is similar to FIG. 5, but showing that the propeller is revolved clockwise.

When the electric motor 32 is started, the first transmission shaft 34 is driven by the output shaft 322 to rotate, which in turn drives the second transmission shaft 52 to synchronously rotate due to the engagement of the first gear 37 with the second gear 55, which in turn drives the propeller 53 to rotate so as to propel the boat forward. If the electric motor 32 runs reversely, the boat will sail backward. In addition, the electric outboard drive 20 is further equipped with a tiller 70 having an end mounted to the base 36 of the motor housing 31 for turning the driving device 30 leftward or rightward, as shown in FIGS. 5-7. When the tiller 70 is turned by a user, because the motor housing 31 of the driving device 30, the connecting tube 60 and the fluid guiding member 51 of propelling device 50 are connected with each other, the propeller 53 of the propelling device 50 will be synchronously revolved about the center axis of the mounting collar 41 so as to effect the steering control of the boat 10.

As indicated above, the electric outboard drive 20 of the present invention has the advantages as follows.

1. Utilizing the electric motor 32 as the propulsion power makes the electric outboard drive 20 of the present invention have a light weight and a low pollution so as to meet the environmental protection requirement. Because of the lightweight design, the electric outboard drive 20 of the present invention can be conveniently detached from the boat 10 for transportation and/or storage so as to minimize the risk of being stolen.

2. The steering control of the boat 10 can be effected by a tiller 70 having a simple structure, which simplifies the overall construction of the outboard drive of the present invention.

3. The installation location of the battery unit 14 can be adjusted according to an actual need to shift the center of gravity of the boat. In addition, since the electric motor that can be used in the electric outboard drive present will not be limited by the available space of the electric outboard drive, various specifications of the electric motors can be chosen subject to the size of the boat for providing sufficient propulsion power to the boat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric outboard drive adapted to be mounted to a transom of a boat for propelling the boat, the electric outboard drive comprising:

a driving device including a motor housing, an electric motor mounted inside the housing and provided with an output shaft, and a first transmission shaft extending downwardly and having a top end connected with the output shaft of the electric motor such that the first transmission shaft is rotatable by the output shaft of the electric motor;

a mounting bracket for being detachably mounted to the transom of the boat, the housing of the driving device being rotatably connected with the mounting bracket;

a propelling device including a fluid guiding member into which a bottom end of the first transmission shaft extends, a second transmission shaft transversely and rotatably disposed in the fluid guiding member and provided with a front end engaged with the bottom end of the first transmission shaft such that the second transmission shaft is rotatable by actuation of the first transmission shaft, and a rear end extending out of the fluid guiding member, and a propeller connected with the rear end of the second transmission shaft; and a connecting tube connected between the motor housing of the driving device and the fluid guiding member of the propelling device, and housing the first transmission shaft;

wherein the mounting bracket comprises a mounting collar sleeved onto the motor housing, a bearing disposed between the mounting collar and the motor housing, two links, each of which has a first end pivotally connected to one of two opposite sides of the mounting collar, and a second end, a hanger having a top edge pivotally connected with the mounting collar, a bottom edge pivotally connected with the second ends of the links, and a bent hanging rack for being hung on the transom of the boat, and a tightening bolt screwingly inserted into the hanging rack with a free end for stopping at the transom of the boat.

2. The electric outboard drive of claim 1, further comprising a tiller having an end horizontally connected with the motor housing for actuating the driving device to rotate relative to the mounting bracket.

3. The electric outboard drive of claim 1, wherein the bottom end of the first transmission shaft is provided with a first gear and the front end of the second transmission shaft is provided with a second gear engaged with the first gear.

4. The electric outboard drive of claim 1, wherein a bearing is disposed between the first transmission shaft and the fluid guiding member.

5. The electric outboard drive of claim 1, wherein the first transmission shaft is substantially perpendicular to the second transmission shaft.

6. The electric outboard drive of claim 1, wherein the connection tube is an aluminum-extruding tube.

* * * * *